US007806349B2

(12) United States Patent
Noelle

(10) Patent No.: US 7,806,349 B2
(45) Date of Patent: Oct. 5, 2010

(54) DEVICE FOR SPRAYING WATER JETS WITH REMOVABLE SEAL SUPPORT

(75) Inventor: Frédéric Noelle, Saint-Nazaire les Eymes (FR)

(73) Assignee: Rieter Perfojet, Montbonnot (FR)

( * ) Notice: Subject to any disclaimer, the term of this patent is extended or adjusted under 35 U.S.C. 154(b) by 0 days.

(21) Appl. No.: 10/504,103

(22) PCT Filed: Feb. 18, 2003

(86) PCT No.: PCT/FR03/00518

§ 371 (c)(1),
(2), (4) Date: Aug. 10, 2004

(87) PCT Pub. No.: WO03/070378

PCT Pub. Date: Aug. 28, 2003

(65) Prior Publication Data

US 2005/0139700 A1 Jun. 30, 2005

(30) Foreign Application Priority Data

Feb. 19, 2002 (FR) ..... 02 02068

(51) Int. Cl.
*B05B 17/00* (2006.01)

(52) U.S. Cl. ..... 239/589; 239/553; 239/553.3; 239/556; 239/568; 239/590; 239/600

(58) Field of Classification Search ..... 239/596, 239/600, 533.11, 553, 553.3, 553.5, 555, 239/556, 566, 553.11, 568, 601, 554, 557, 239/558, 559, 567, 589, 590–590.5, DIG. 4
See application file for complete search history.

(56) References Cited

U.S. PATENT DOCUMENTS 3,613,999 A * 10/1971 Bentley et al. ..... 239/553.3
4,930,657 A * 6/1990 Walker ..... 220/235
5,042,722 A * 8/1991 Randall et al. ..... 239/553.5
5,692,278 A * 12/1997 Fleissner ..... 28/105

FOREIGN PATENT DOCUMENTS

DE 199 21 694 A1 5/1999
DE 19921694 A1 * 11/2000
EP 0 725 175 B1 3/1999

* cited by examiner

*Primary Examiner*—Jason J Boeckmann
(74) *Attorney, Agent, or Firm*—Knobbe Martens Olson & Bear LLP

(57) ABSTRACT

The invention relates to a device for spraying water, provided with a seal support (21) arranged between the body (1) and the perforated sheet (23) and in contact with the above. The seal support is mounted such as to be able to be removed from the body (1) with the joint (20). The above finds application in the production of non-woven materials.

8 Claims, 8 Drawing Sheets

DEVICE FOR SPRAYING WATER JETS WITH REMOVABLE SEAL SUPPORT

BACKGROUND OF THE INVENTION

1. Field of the Invention

The present invention relates to a water jet spray device that is particularly useful in the hydroentanglement of fibres in nonwovens. Hydroentanglement involves sending a curtain of jets of water under pressure onto a web of fibres to entangle them and form them into a coherent web, without requiring the use of binders or resins.

2. Description of the Related Art

EP-0 725 175 discloses a water jet spray device comprising a pressure-resistant body defining an internal chamber. The oblong cylindrical internal chamber has one entrance, and preferably two entrances, one in each end face, and communicates, through an interposed perforated plate, with an outlet leading out of the body. The perforated plate is in contact with a seal. To facilitate replacement of the annular seal applied to the perforated plate, without the chore of removing screws and disassembling it, there is provided, all the way along the length and across the width of a groove containing the seal, a repair groove whose height is approximately the same as the thickness of the seal and a longitudinal metal sheet can be inserted into this repair groove, this longitudinal metal sheet having, on its lower face, a device for gripping the seal. To replace the seal which is removed as best one can, the metal sheet with a new seal is put into the repair groove and, with the aid of a tool, the new seal is rolled down where it must slide into the groove where it is to be housed. DE-A-199 21 694 improves on the device disclosed in EP 0 725 175 in order to simplify the fitting process. For this purpose it uses a seal holder of circular cross section that also carries the perforated plate. In the factory, the seals are placed in the seal holder and the seal holder is put into position in the body once for all, before installing the body. If the seal wears out, though it is emphasized that this rarely happens, it is easily replaced in the manner disclosed in EP-0 725 175. Experience has shown that performing these seal replacing operations is an operation that demands too much skill to be carried out in a short space of time, especially when it comes to very long seals measuring several meters.

U.S. Pat. No. 5,042,722 discloses a water jet spray device having a pull-out cassette in a body and comprising a perforated plate, a seal holder and a spacer. Just as in the previous documents, the cassette is large and therefore requires a large hole to be made in the body. This is undesirable from the point of view of pressure resistance, and replacing the perforated plate and/or the seal holder is a complicated task, since the spacer has to be unscrewed to allow access to the perforated plate.

SUMMARY OF THE INVENTION

The invention mitigates these problems in the form of a device in which seal replacement can be done reliably and in a short space of time, even by an inexperienced operator. Furthermore, the number of parts is reduced and the integrity of the body is less undermined.

The subject to the invention is a water jet spray device made up of basis components: a body, at least one clamp and a perforated plate, the clamp being fixed to the body in such a way as to keep the perforated plate, supported by a seal holder, held in position thereon and the device comprising means designed to spray water from the inside of the body out through the perforated plate and means for maintaining the shape of the seal holder, which device is characterized in that the maintaining means are formed by one of the basis components themselves.

To replace the seal, the seal holder containing the old seal is withdrawn and placed on the workbench, and the damaged old seal is removed perfectly easily without having to first remove a spacer. Then a new seal is put in its place, again perfectly easily because of the good access to the top of the seal holder which is placed flat on the workbench and there is not the difficulty of having to work in a confined space inside the body. These operations done, the seal holder with the seal in place is put back into the device with a simple sliding movement.

The perforated plate is preferably mounted in such a way that it can be withdrawn from the body independently of the seal holder. If only the perforated plate needs replacing, the seal holder can thus be left in place.

For better sealing, a first annular seal carried by the seal holder is in contact with the perforated plate, while a second annular seal carried by the seal holder is in contact with the body. The two seals extend one on each of the opposite faces of the seal holder. They are preferably rectangular seals with rounded vertices.

The seal holder is preferably in the form of a 2 to 10 mm-thick plate. Because this is not very thick, the jets do not lose much of their speed when they pass through the slit formed in the seal holder before passing out through the outlet.

In one very particularly preferred embodiment, the guide parts are so shaped as to allow the seal holder to slide in a direction parallel to the axis but with the possibility of movement in the two directions perpendicular to the perforated plate, the seal holder being in particular a U shaped bar, the web of the U carrying the seals, and the two arms of the U pointing towards the inner chamber fitting into respective grooves in the body designed to guide the seal holder and deeper than the height of the arms. The presence of these arms and grooves does not therefore make the clamp harder to screw onto the body during manufacture. The body has spacer parts for keeping the guide parts at the correct distance. This ensures that the seal holder maintains its geometry and its position, even when the jet spray device is at an angle to the vertical, which is frequently the case when it is fitted around a cylinder. The spacer parts may coincide with the indexing parts.

In another embodiment, the guide parts are ribs which are provided on only one of the end parts of the seal holder and which engage with grooves in the body acting as the indexing parts, and are formed along only a length corresponding approximately to that of the grooves.

The invention also relates to a method of replacing a seal of a device, characterized in that in succession, without unscrewing the clamp from the block of the device, the assembly consisting of the seal holder and the perforated plate is withdrawn from the device, the perforated plate is separated from the seal holder the worn seal is removed from the seal holder, a new seal is placed in the seal holder, the perforated plate is put back on the seal holder in such a way as to produce a new assembly, and the new assembly is put back exactly in position in the device by engaging the guide parts and indexing parts together.

In one embodiment, the guide parts are ribs which are formed on only one of the end parts of the seal holder and which fit into grooves in the body which are the indexing parts and are formed along a length approximately equal to that of the grooves and the new assembly is put back by inserting it via the said end part.

The invention also relates to an installation for entangling fibres in a nonwoven, comprising a cylinder, around the lateral face of which the fibres to be entangled are passed and a device according to the invention in which the jets are aimed at the lateral face of the cylinder.

BRIEF DESCRIPTION OF THE DRAWINGS

In the attached drawing, which is given purely by way of example.

DETAILED DESCRIPTION OF THE PREFERRED EMBODIMENTS

Figure 1:
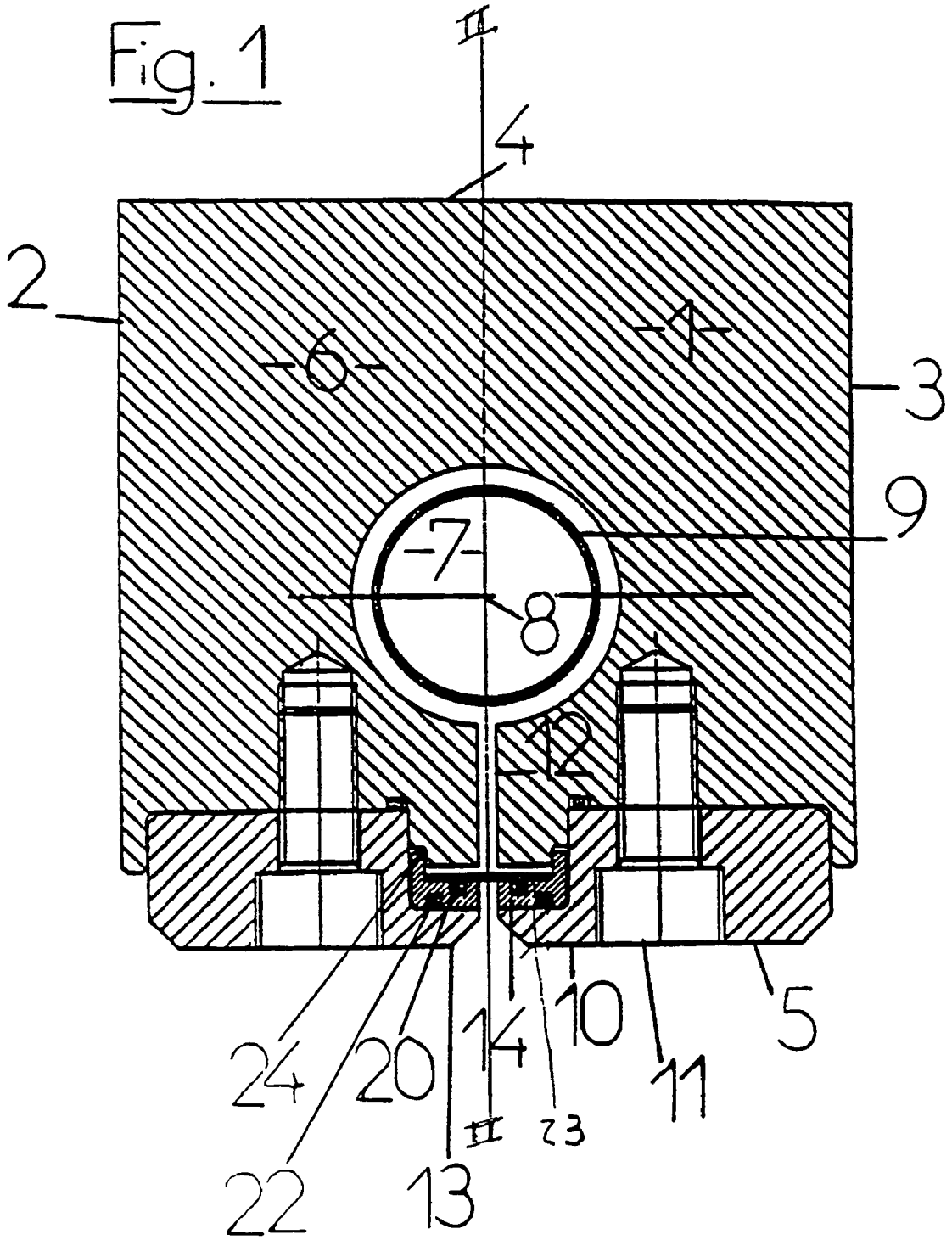
FIG. 1 is a cross section through a preferred device according to the invention on a plane perpendicular to the axis of the inner chamber.
Figure 2:
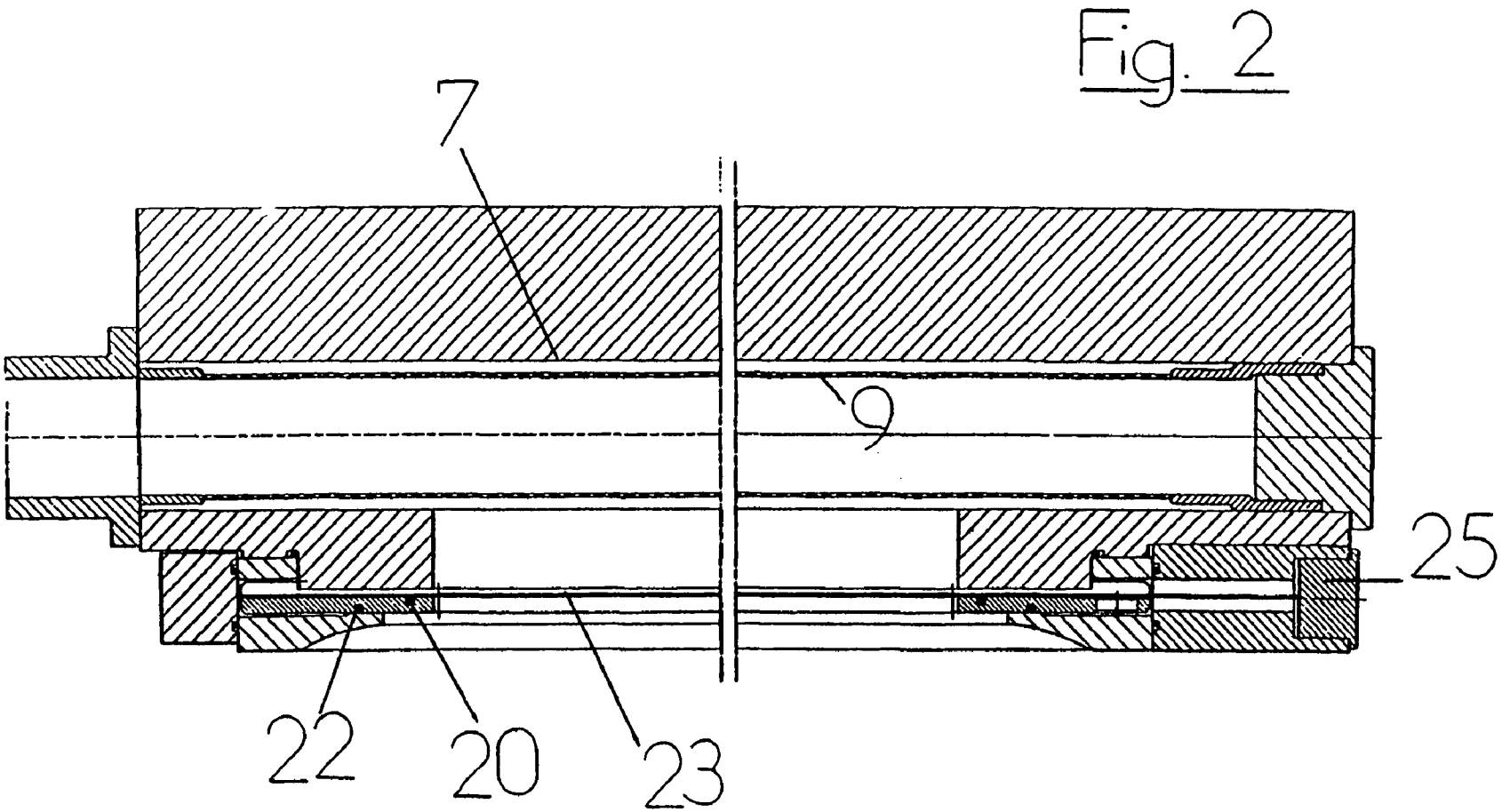
FIG. 2 is a cross section on the line marked II-II in FIG. 1.
Figure 3:
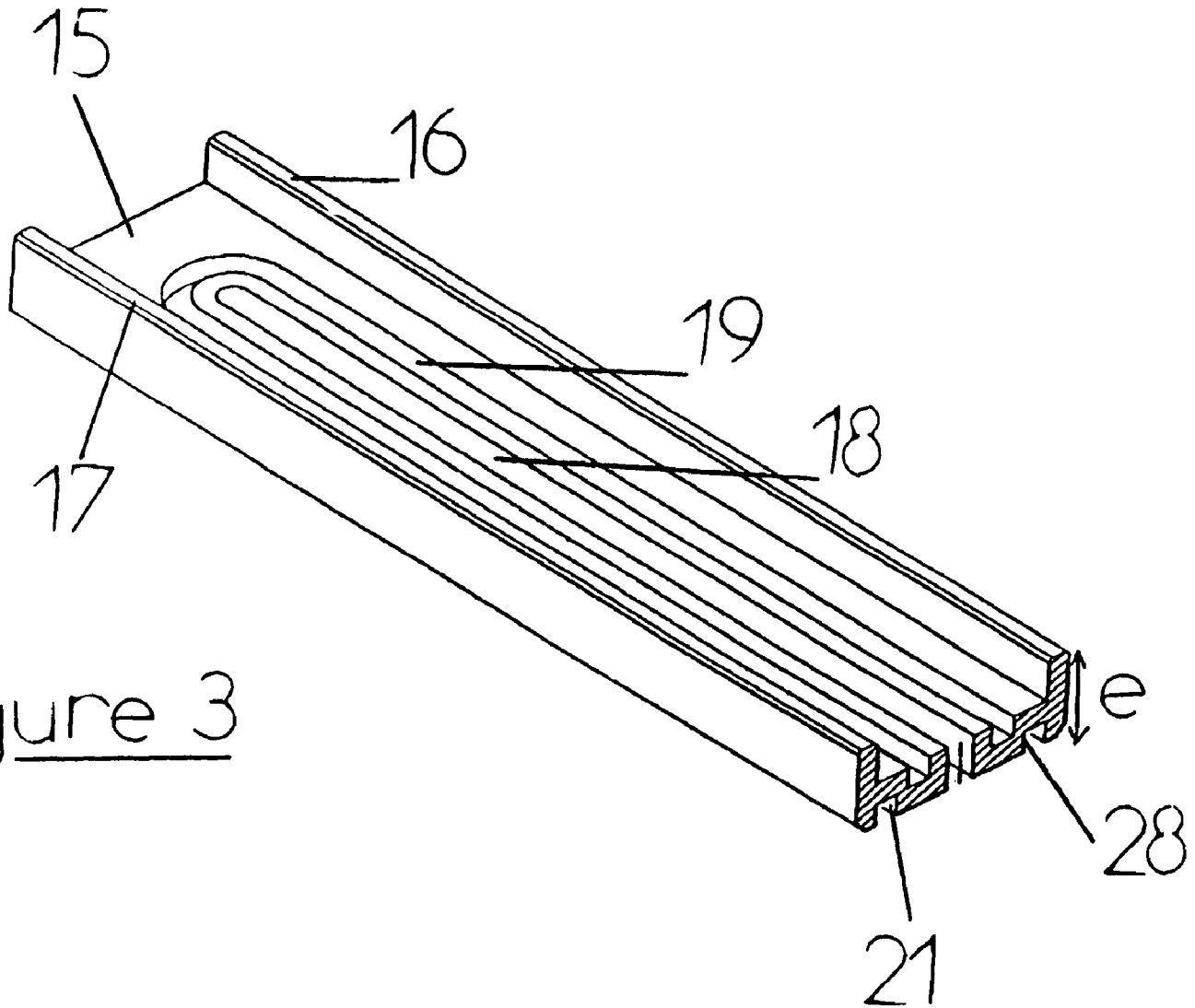
FIG. 3 is a partial perspective view of the seal holder.

Referring to FIGS. 1 to 3, the jet spray device according to the invention comprises a fixed body 1 of parallelepipedal shape having two opposite large faces 2, 3, two opposite small faces 4, 5, and two opposite, end faces 6. The body 1 is made of steel. An oblong chamber 7 of axis 8 is made in the body 1 from one end face 6 to the other. Both end faces 6 have connectors (not shown) forming an inlet communicating with a pressurized water source, which is not illustrated. The chamber 7 contains a cylindrical filter 9, of the same shape as the chamber 7 but of smaller diameter.

The face 5 of the body consists of two clamps 10 screwed to the rest of the body 1 by screws 11.

A channel 12 in the form of a slit extending along one generatrix or two adjacent generatrices of the chamber 7 leads from the chamber 7 to an opening 13 in the form of a slit formed in the face 5 and communicating with the exterior.

The clamps 10 define a cavity housing a seal holder 14 made of metal, plastic or a composite material, having a 5 mm thick web 15 and two side arms 16, 17 forming guide parts extending parallel to the axis 8. The seal holder includes a longitudinal slit 18 aligned with the channel 12 and with the outlet 13. On either side of the slit 18, the seal holder 14 comprises a groove 19 which faces in towards the chamber 7 and which houses an annular seal 20. On the opposite face, the seal holder 14 has an annular groove 21 like the groove 19 and housing a second annular seal 22. The seal 20 is closer to the slit 18 than the seal 22. Placed against the face containing the seal 20 is a perforated plate 23 with microperforations of diameter between 50 and 500 microns, and preferably between 100 and 200 microns, which is used to form jets or needles of water. These perforations are arranged in one or two rows parallel to the axis 8 in line with the slit 18.

The arms 16, 17 fit into grooves 24 formed in the body 1 and this seal holder 24 can be removed from the device, after a plug 25 has been withdrawn. Likewise for the perforated plate 23. The solid part of the body 1 between the grooves 24 acts as a spacer and thus maintains the shape of the seal holder 14 in spite of its thinness, preventing it from closing up when subject to the pressure forces.

To facilitate assembling the device, the free edges of the edge parts 16, 17 of the seal holder are at a distance from the bottom of the grooves 24. When the clamps 10 are screwed onto the main part of the block 1, the clearance between the edges 25 of the edge parts 16, 17 of the seal holder 14 and the block 1 ensures that there will be no blockage as the screws are driven in.

Figure 4:
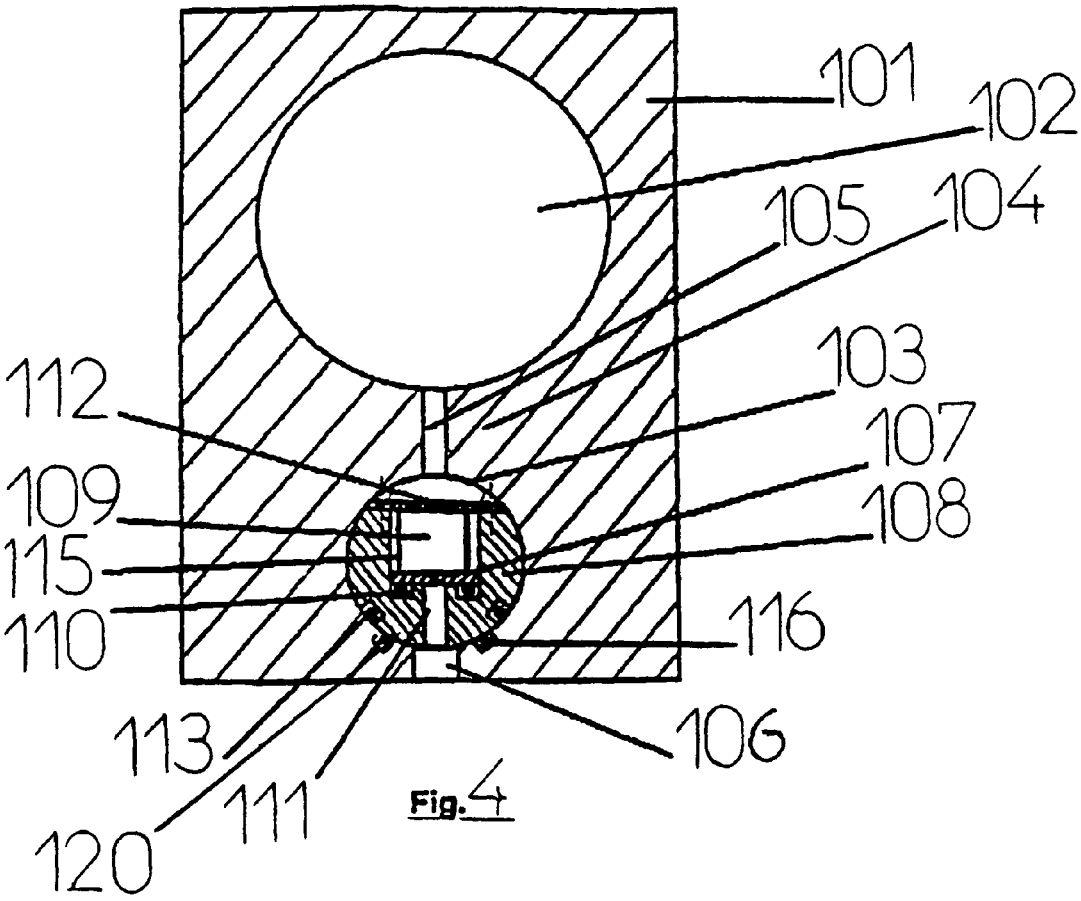
FIG. 4 is a cross section similar to FIG. 1 through a variant.
Figure 5:
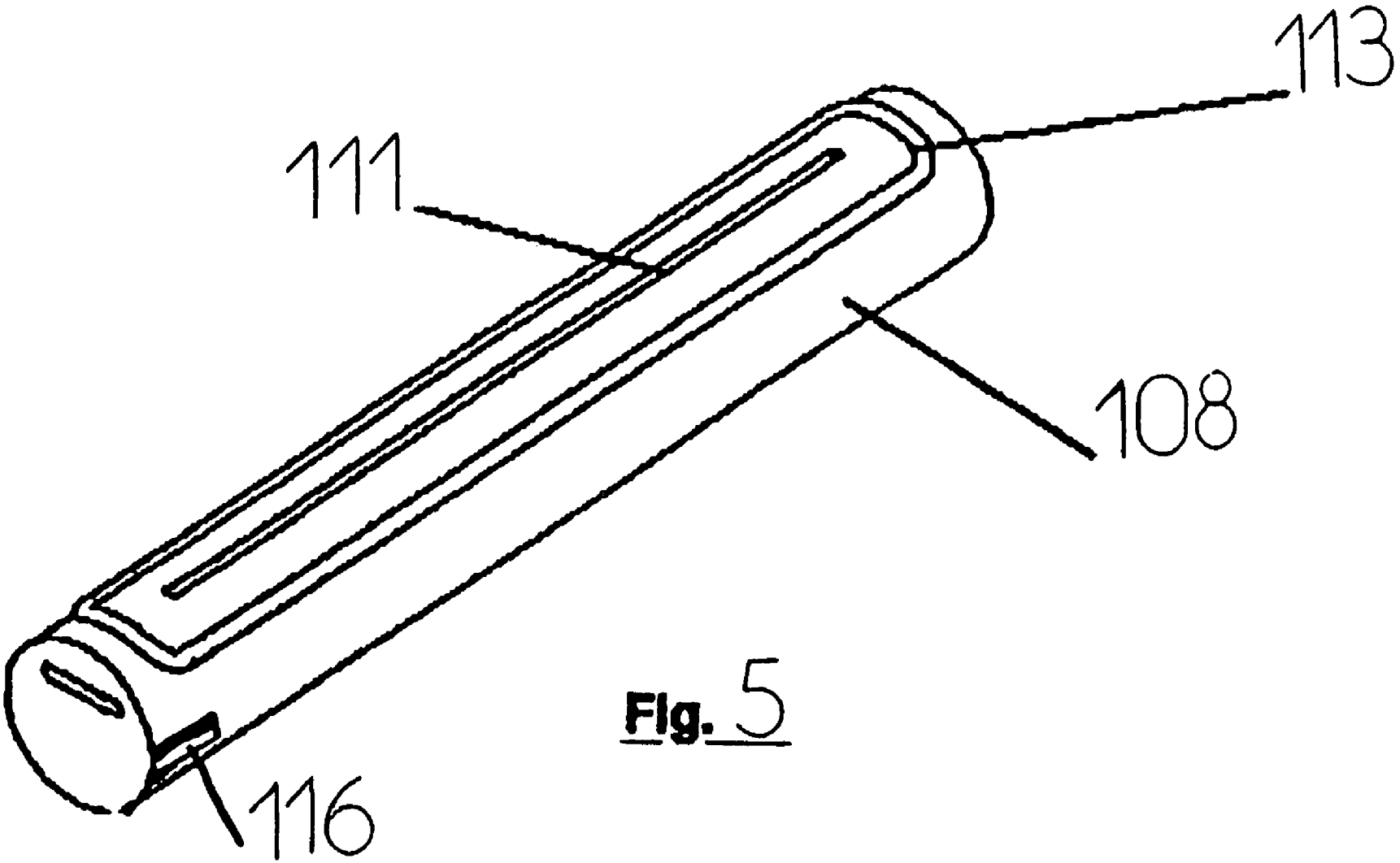
FIG. 5 is a perspective view of the seal holder of the variant of FIG. 4, FIGS. 6 to 8 are cross sections through three variants.

In the variant shown in FIGS. 4 and 5, the body 101 has two longitudinal bores 102 and 103. The two bores 102 and 103 are separated from each other by an intermediate wall 104 in which through-holes 105 are made allowing communication between the bores 102 and 103. In line with these through-holes, on the other side of the bore 103, is a narrower slit 106 for the liquid outlet. The bore 102 is supplied with pressurized water by a source which is not presented. A perforated plate 107 is mounted in a cylindrical seal holder 108 whose outside diameter fits the diameter of the chamber 103 and which can slide along the chamber 103. A filter 112 is mounted on top of the seal holder 108. To install the perforated plate 107 with the aid of a part 115 which presses it against the seal holder 108, the cylindrical seal holder 108 has a first longitudinal slit 109 that extends in the axial direction of the seal holder 108 and is about the same width as the perforated plate 107. An annular seal 110 is housed in the bottom of the first longitudinal slit 109. On one of the end faces of the cylindrical seal holder 108 there is, at least in the width of the seal-holding plate 107, a slit 104, more clearly visible in FIG. 5, so that the seal-holding plate 107 can be replaced without removing the seal holder 108. However, another way is to remove the seal holder 108 from the water jet spray device by sliding it out.

Continuing on from the longitudinal slit 109, on the other side of the seal holder 108, is a second, narrower longitudinal slit 111, via which the jets of liquid produced by the perforated plate 107 arrive in the slit 106 of the body 101.

As shown in FIG. 5, the seal holder 108 comprises two ribs 116 which extend along only part of its length from the end containing the slit 104. These ribs 116 act as guide parts and are complementary in shape with grooves formed in the body 101 acting as indexing parts.

To fit the seal holder 108 into the body 101, it is engaged via the end 113 into the body 101 until the ribs 116 are in their grooves 120. The seal holder 108 is thus fixed in position and cannot rotate. To change the seal, the seal holder 108 is withdrawn by sliding it out parallel to its axis in the same way as the perforated plate 107 slides, the worn seal is removed, a new seal is put in place—these two operations being performed perfectly easily on the workbench—and the seal holder 108 is reinserted into the body 101.

Under pressure, the seal holder would tend to close in but is prevented from doing so by the body, with the result that the perforated plate experiences no mechanical stress from the seal holder. The perforated plate is not squeezed by the seal holder. The spacing feature allows the seal holder to be kept central when the injection device is under pressure.

Figure 6:
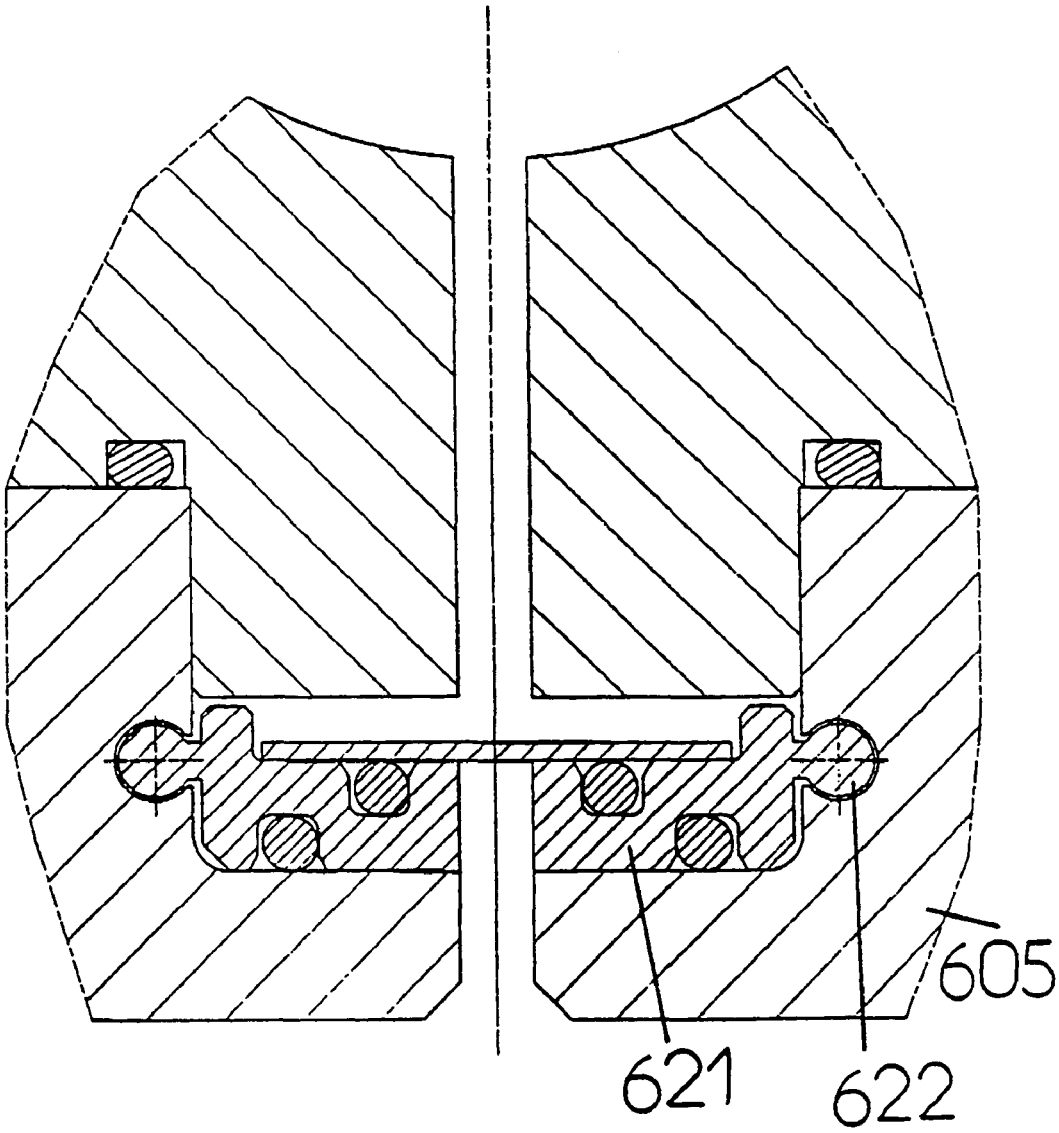

In FIG. 6 the maintaining means are represented by the fact that the seal holder 621 comprises in cross section two balls 622 which are guided in the body 605. The shape of the seal holder 621 is thus maintained due to the fact that the balls 622 are engaged in complementary retaining cavities in the clamp 605.

Figure 7:
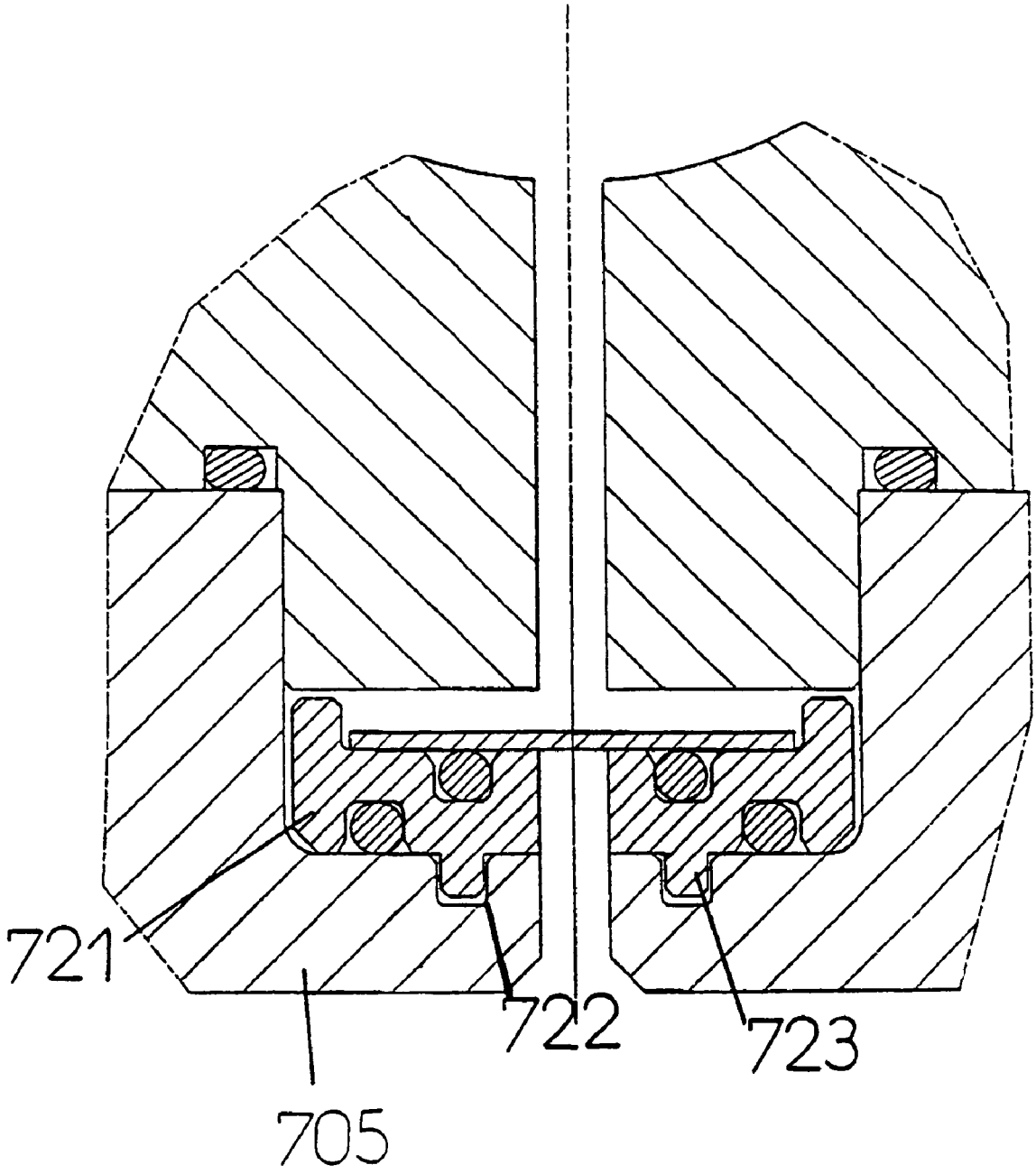

In FIG. 7, the clamp 705 contains two grooves 722 parallel to the axis of the device, with two ribs 723 projecting into them from the seal holder 721.

Figure 8:
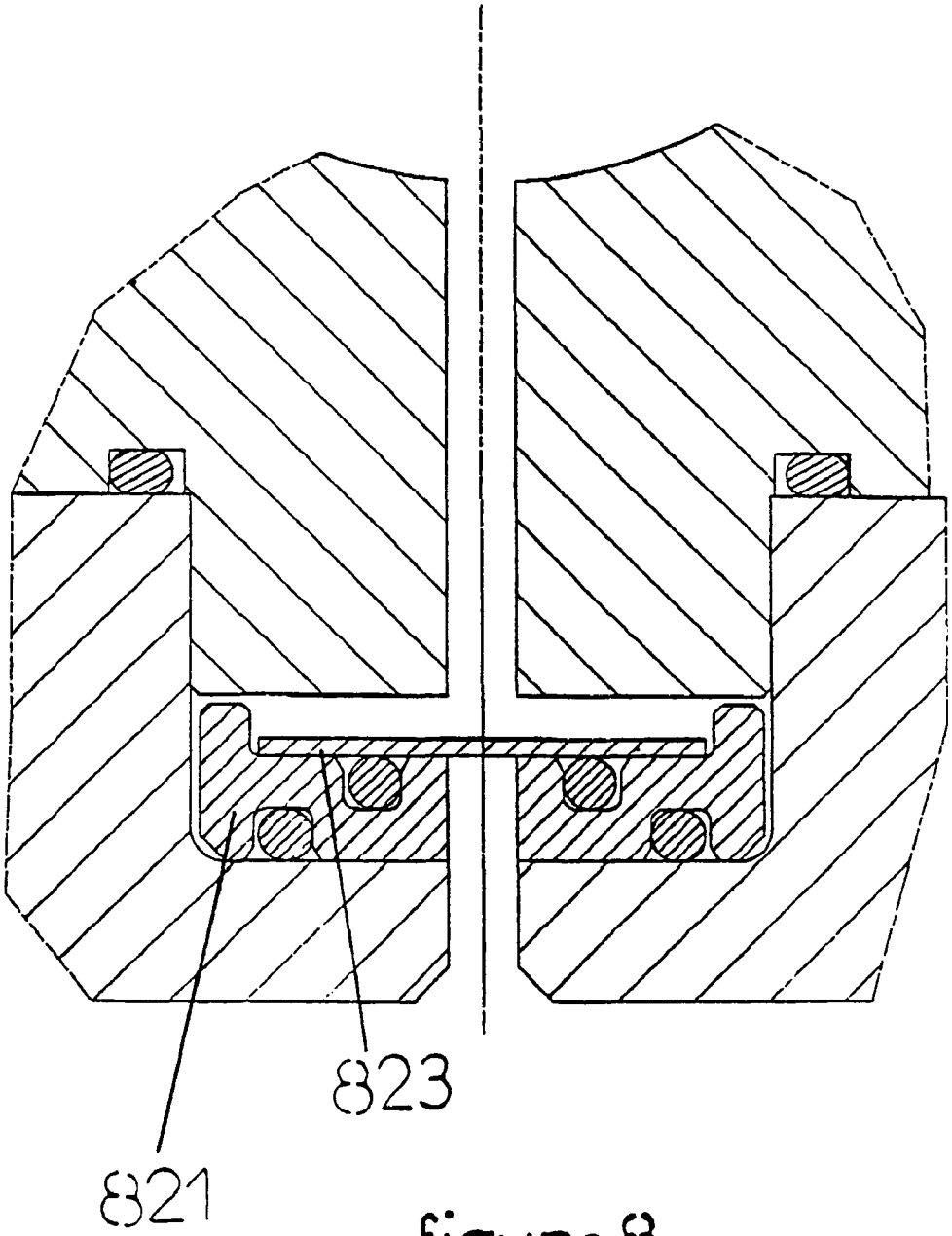

Finally, in FIG. 8, it is the perforated plate 823 itself that acts as a spacer for the seal holder 821. In this case, to replace the seal holder, the perforated plate 823 and the seal holder 821 are both removed together from the device. On the workbench, the perforated plate 823 is then removed, if necessary by prizing open the two edge parts of the seal holder 821. This is the simplest embodiment, but in spite of that it not preferred because in the first place it is more complicated to replace the seal holder, and in the second place it imposes harmful stresses on the seal-holding plate.

The invention claimed is:

1. A water jet spray device comprising:

a body having two opposite side faces defining the outside of the device, two opposite end faces extending generally normal to the two opposite side faces, a top face and a bottom face, a single cylindrical pressurized chamber with a longitudinal axis from one end face to the other end face and a part extending from said body, wherein said part is integral with said body;

a clamp secured relative to said body by screws and defining a bottom face of the device, said part extending from said body towards said clamp, said clamp and said part defining a first groove and a second groove on opposite sides of said part, said first groove and said second groove being parallel to said longitudinal axis;

a cavity defined between said clamp and said part;

a channel in the form of a slit extending along a generatrix of the chamber through said part directly connecting said chamber to said cavity;

a one-piece seal holder configured to releasably hold a seal, said seal holder being positioned within said cavity and having two arms, said two arms being fitted in said grooves so as to inhibit deformation of said seal holder when said seal holder is subject to pressure forces; and a perforated plate disposed between at least portions of said seal holder and said part.

2. The water jet spray device of claim 1, wherein the perforated plate can be removed independently of the seal holder.

3. The water jet spray device of claim 1, wherein the one-piece seal holder comprises a plate having a thickness of about 2 mm to 10 mm.

4. The water jet spray device of claim 1, wherein the one-piece seal holder is U-shaped and comprises two legs.

5. The water jet spray device of claim 4, wherein a surface of the one-piece seal holder in between the two legs includes a seal holding groove which houses a seal.

6. The water jet spray device of claim 5, wherein the perforated plate is placed against the seal.

7. The water jet spray device of claim 5, wherein the one-piece seal holder further comprises a second seal holding groove on an opposite surface from the first seal holding groove.

8. A water jet spray device comprising:

a body having two opposite side faces defining the outside of the device, two opposite end faces extending generally normal to the two opposite side faces, a top face and a bottom face, a cylindrical pressurized chamber with a longitudinal axis from one end face to the other end face;

a clamp secured relative to said body by screws and defining a most bottom face of the device wherein the opposite side faces and opposite end faces of the body are disposed completely between the most bottom face of the device and the top face of the body, said clamp having two grooves parallel to said axis;

a cavity defined between said clamp and said body;

a channel part directly connecting said chamber to said cavity;

a one-piece seal holder configured to releasably hold a seal, said seal holder being positioned within said cavity and having two ribs, said two ribs projecting into said grooves so as to inhibit deformation of said seal holder when said seal holder is subject to pressure forces; and a perforated plate supported by said seal holder.

* * * * *